United States Patent [19]

Rodrigue

[11] 4,195,839

[45] Apr. 1, 1980

[54] PROJECTILE TARGET WITH REMOVABLE RODS

[76] Inventor: Wilbrod Rodrigue, 85 Barton St., East, Hamilton, Ontario L8L 2N1, Canada

[21] Appl. No.: 972,333

[22] Filed: Dec. 22, 1978

[51] Int. Cl.[2] ..... F41J 3/00

[52] U.S. Cl. ..... 273/346; 273/403; 273/404

[58] Field of Search ..... 273/102 B, 207, 102.4; 272/56.5 SS

[56] References Cited

U.S. PATENT DOCUMENTS

| | | | |
|---|---|---|---|
| 1,837,627 | 12/1931 | Mead et al. | 273/102 B |
| 2,633,360 | 3/1953 | Fleigle | 273/102 B |
| 3,048,401 | 8/1962 | Dishon | 273/102 |
| 3,100,115 | 8/1963 | Breneman | 273/102.4 |
| 3,203,698 | 8/1965 | Saunders | 273/102.4 |
| 3,396,971 | 8/1968 | Estep | 273/102 B |
| 3,451,683 | 6/1969 | Oliver | 273/207 |

FOREIGN PATENT DOCUMENTS

| | | | |
|---|---|---|---|
| 520858 | 1/1956 | Canada | 273/102 B |
| 2702502 | 7/1978 | Fed. Rep. of Germany | 273/102 B |
| 639503 | 6/1950 | United Kingdom | 273/102 B |
| 1498708 | 1/1978 | United Kingdom | 273/102 B |
| 1508961 | 4/1978 | United Kingdom | 273/102 B |
| 1515771 | 6/1978 | United Kingdom | 273/102 B |

*Primary Examiner*—Richard C. Pinkham
*Assistant Examiner*—Lawrence E. Anderson

[57] ABSTRACT

A target for projectiles is disclosed. The target comprises a base plate, a plurality of studs mounted on the base plate parallel to each other, a plurality of rods bundled together and having one end removably secured to the end of the studs and the other end facing in the direction from which the projectiles are launched, and apparatus on the periphery of the bundle of rods for holding the rods under compression.

5 Claims, 4 Drawing Figures

PROJECTILE TARGET WITH REMOVABLE RODS

This invention relates to a target for projectiles, and more particularly to an archery target.

BACKGROUND OF THE INVENTION

Archery targets are generally made of compressed fibrous material, such as straw. However, the fibrous material is rapidly damaged particularly in the centre of the target due to the large number of shots which are directed to that area. Indeed, the centre area of the target becomes so torn after a while that it is difficult to land a solid hit in the vicinity of the bullseye. To overcome this problem, it has been proposed in U.S. Pat. No. 3,396,971 to replace the fibrous material, at least in the centre of the target, by a bundle of rods disposed longitudinally in the direction of the arrows and held in compression by means of bands encircling the bundle of rods. However, the rods also become damaged after a while and it is a time-consuming job to replace them since the bundle of rods must be completely dismantled.

SUMMARY OF THE INVENTION

It is therefore the object of the present invention to provide a target for projectiles which is made of a plurality of bundled rods disposed parallel to one another and in which the individual rods may be easily removed and replaced by a new rod when they become damaged.

The target for projectiles, in accordance with the invention, comprises a base plate, a plurality of studs mounted on the base plate parallel to each other, a plurality of rods bundled together and having one end removably secured to the end of the studs and the other end facing in the direction from which the projectiles are launched, and means on the periphery of the bundle of rods for holding the rods under compression.

The means for holding the bundle of rods under compression is preferably a peripheral outer cover which is lined with resilient material.

In a preferred embodiment of the invention, the base plate has a plurality of holes through which the studs extend with the head of the studs resting against the back of the plate, and a backing plate is secured to the base plate and contacts the head of the studs for holding the studs in position. A foam or rubber pad is preferably mounted on the base plate for holding the studs in parallel relationship and for absorbing the vibrations of the rods when they are stuck by the projectiles.

A base board is preferably secured to the backing plate of the target and support means are mounted on the base board for supporting the target in shooting position.

BRIEF DESCRIPTION OF THE DRAWINGS

The invention will now be disclosed, by way of example, with reference to the accompanying drawings in which.

DETAILED DESCRIPTION OF AN EMBODIMENT OF THE INVENTION

Figure 2:
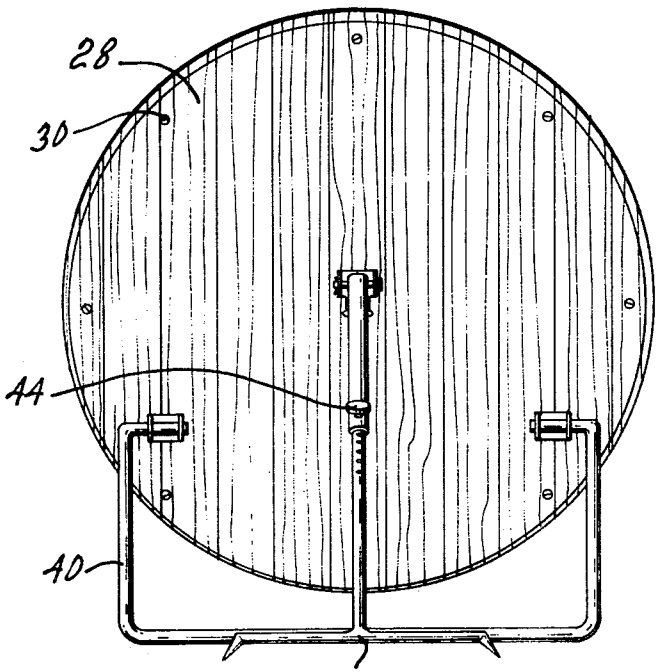
FIG. 2 is a back view of the target in accordance with the invention.
Figure 1:
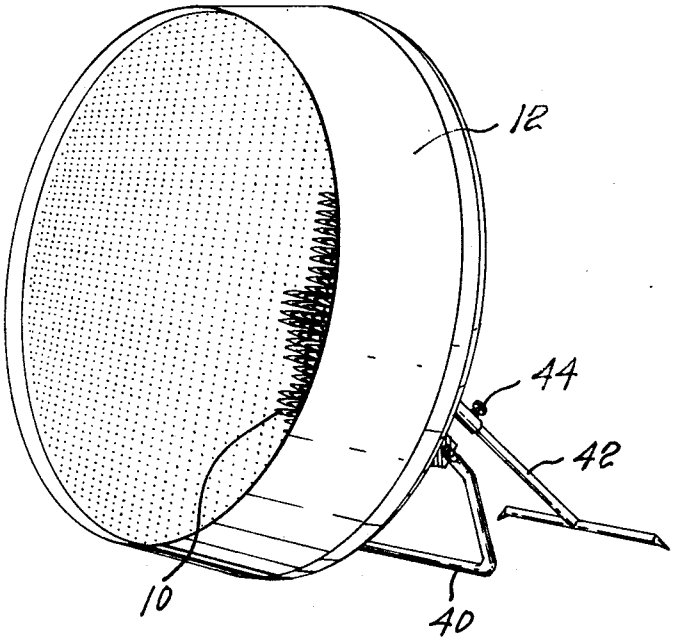
FIG. 1 is a perspective view of the target in accordance with the invention.
Figures 3, 4:
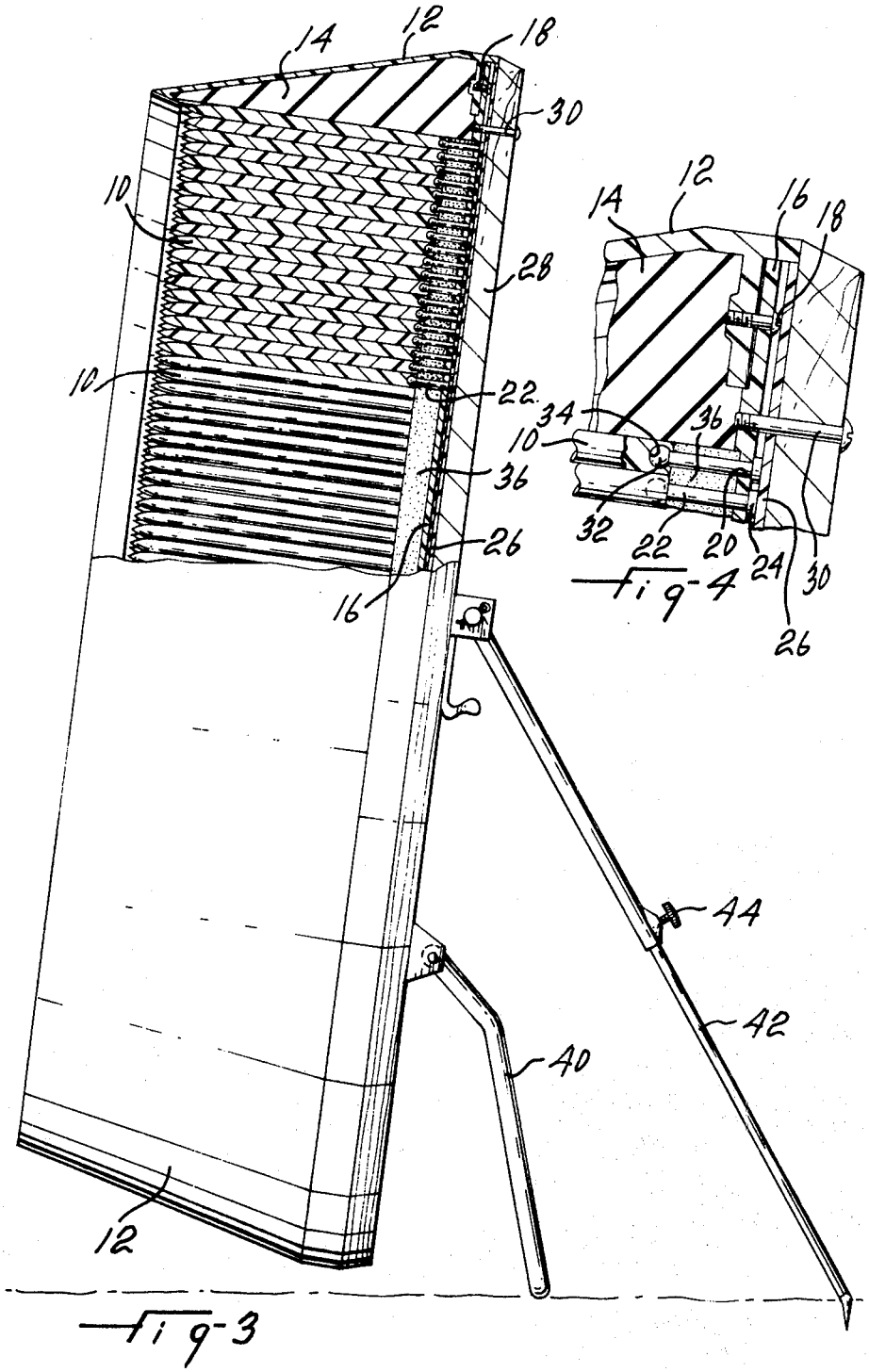
FIG. 3 is a partial section view of the target.
FIG. 4 is a partial section view of the target shown in FIG. 3.

Referring to the drawings, there is shown an archery target comprising a plurality of rods 10 made of plastic or other suitable material which are bundled together in parallel relationship by means of a peripheral cover or ring 12 lined with a pad 14 made of resilient material, such as rubber. As shown more clearly in FIG. 4, the ring 12 is secured to the edge of a base plate 16 by bolts 18. The ring 12 may be made of nylon, fiberglas or other suitable material. Base plate 16 may be made of metal or strong plastic material.

The base plate is provided with a plurality of regularly spaced holes 20 through which extend studs 22 made of metal or nylon material. The studs have a head 24 abutting on the back of the base plate 16 and are held in position by a backing plate 26 which is secured to the base plate 16. The backing plate is optionally covered with a base board 28 and the base plate 16, the backing plate 26 and the base board 28 are secured together by means of bolts 30. The opposite end of the studs is ball-shaped as indicated at 32 and the end of each rod is provided with a blind socket 34 corresponding to the size of the ball 32 at the end of each stud. The rods are secured to the studs simply by forcing the balls of the studs into the sockets in the rods. This way, the rods may be easily pulled out when damaged and replaced by new ones. The studs are held in parallel relationship by means of a foam rubber mattress 36 provided with a plurality of regularly-spaced holes. The foam rubber mattress also absorbs the shock when the rods are struck by the arrows. The ends of the rods are pointed so as to permit the arrows to easily slide in between the rods when they hit the target.

The target is supported on a stand 40. The angle of the target is adjusted by means of a leg 42 which is provided with adjustment screw 44.

When an arrow hits the target, the pointed arrow head is embedded between adjacent rods and its forward movement is halted by the friction of the rods. When the arrow is pulled out, the displaced rods come back to their original position under the compressive force exerted by the resilient rubber pad 14 inside ring 12. If a rod becomes damaged, it is simply pulled out by the pointed end and replaced by a new one.

The ends of the rods may also be coloured to show the usual target lines if desired. Of course, conventional target sheets may also be secured to the front end of the rods.

Although the invention has been disclosed, with reference to a preferred embodiment, it is to be understood that the invention is not limited to such embodiment and that other alternatives are also covered. For example, the peripheral cover which is used to bundle the rods together need not be circular. Furthermore, any means for holding the bundled rods in peripheral compression may be used. Also, other means for mounting the studs on a back plate are envisaged.

What I claim is:

1. A target for projectiles comprising:

(a) a base plate;

(b) a plurality of studs mounted on said base plate parallel to each other;

(c) a plurality of rods bundled together and each rod having one end removably secured to the end of said studs and the other end facing in the direction from which the projectiles are launched; and (d) means on the periphery of said bundle of rods for holding the rods under compression.

2. A target for projectiles as defined in claim 1, wherein said means for holding the bundle of rods under compression is a peripheral outer cover which is lined with resilient material.

3. A target for projectiles as defined in claim 1, further comprising a resilient compressible pad mounted on said base plate for holding the studs in parallel relationship and for absorbing the vibrations of the rods when they are struck by the projectiles.

4. A target for projectiles as defined in claim 1, wherein said base plate has a plurality of holes through which said studs extend with the head of the studs resting against the back of the plate, and further comprising a backing plate secured to said base plate and contacting the head of said studs for holding the studs in position.

5. A target for projectiles as defined in claim 4, further comprising a base board secured to said base plate and further comprising means mounted on said base board for supporting the target in position.

* * * * *